US008662311B2

(12) United States Patent
Gane et al.

(10) Patent No.: US 8,662,311 B2
(45) Date of Patent: Mar. 4, 2014

(54) FROTH FLOTATION PROCESS FOR THE SEPARATION OF SILICATES AND ALKALINE EARTH METAL CARBONATES USING A COLLECTOR COMPRISING AT LEAST ONE HYDROPHOBICALLY MODIFIED POLYALKYLENEIMINE

(75) Inventors: Patrick A. C. Gane, Rothrist (CH); Matthias Buri, Rothrist (CH); Samuel Rentsch, Aarburg (CH); Jörg Sötemann, Villach (AT)

(73) Assignee: Omya International AG, Oftringen (CH)

( * ) Notice: Subject to any disclaimer, the term of this patent is extended or adjusted under 35 U.S.C. 154(b) by 0 days.

(21) Appl. No.: 13/582,607

(22) PCT Filed: Mar. 16, 2011

(86) PCT No.: PCT/EP2011/053983

§ 371 (c)(1),
(2), (4) Date: Nov. 6, 2012

(87) PCT Pub. No.: WO2011/113866

PCT Pub. Date: Sep. 22, 2011

(65) Prior Publication Data

US 2013/0161239 A1 Jun. 27, 2013

Related U.S. Application Data

(60) Provisional application No. 61/341,128, filed on Mar. 26, 2010.

(30) Foreign Application Priority Data

Mar. 19, 2010 (EP) ..... 10157099

(51) Int. Cl.

| | |
|---|---|
| ***B03D 1/01*** | (2006.01) |
| ***B03D 1/016*** | (2006.01) |
| ***B03D 1/02*** | (2006.01) |
| ***B03D 1/12*** | (2006.01) |

(52) U.S. Cl.

CPC .. *B03D 1/01* (2013.01); *B03D 1/02* (2013.01); *B03D 1/016* (2013.01); *B03D 1/12* (2013.01); *B03D 2203/00* (2013.01)

USPC ..... 209/166

(58) Field of Classification Search

USPC ..... 209/166

See application file for complete search history.

(56) References Cited

U.S. PATENT DOCUMENTS

| | | | | |
|---|---|---|---|---|
| 2,356,821 | A | 8/1944 | Christmann et al. | |
| 2,569,417 | A | 9/1951 | Jayne et al. | |
| 3,259,242 | A | 7/1966 | Snow | |
| 3,260,365 | A | 7/1966 | Dickson et al. | |
| 3,425,549 | A * | 2/1969 | Dickson et al. | 209/166 |
| 3,692,092 | A | 9/1972 | Longoria | |
| 3,990,966 | A | 11/1976 | Stanley et al. | |
| 6,138,835 | A | 10/2000 | Jessup et al. | |
| 2003/0212200 | A1 | 11/2003 | Bellas | |
| 2004/0139559 | A1 | 7/2004 | Detering et al. | |
| 2008/0308466 | A1 | 12/2008 | Lumsden | |

FOREIGN PATENT DOCUMENTS

| | | | |
|---|---|---|---|
| CA | 1187212 | A1 | 5/1985 |
| CN | 101321588 | A | 12/2008 |
| DE | 10065846 | A1 | 8/2002 |
| GB | 1343957 | A | 1/1974 |
| WO | 9421368 | A1 | 9/1994 |
| WO | 0121298 | A1 | 3/2001 |
| WO | 02095122 | A1 | 11/2002 |
| WO | 2007110333 | A1 | 10/2007 |
| WO | 2008084391 | A1 | 7/2008 |

OTHER PUBLICATIONS

The International Search Report for PCT Application No. PCT/EP2011/053983, Jul. 6, 2011.

The Written Opinion of the International Searching Authority for PCT Application No. PCT/EP2011/053983, Jul. 6, 2011.

Office Action dated Jul. 2, 2013 for related Chinese Application No. 201180014878.5.

* cited by examiner

*Primary Examiner* — Thomas M Lithgow

(74) *Attorney, Agent, or Firm* — Amber, Rothstein & Ebenstein LLP

(57) ABSTRACT

The invention refers to a process to separate silicates and alkaline earth metal carbonates implementing at least one hydrophobically modified polyalkyleneimine, wherein:

i) the polyalkyleneimine is hydrophobically modified by replacement of all or part of the hydrogens of their primary and/or secondary amino groups by functional group R, where R comprises a linear or branched or cyclic alkyl and/or aryl group and contains 1 to 32 carbon atoms;

ii) prior to modification, the polyalkyleneimine has at least 3 alkyleneimine repeat units and a molecular weight of between 140 and 100 000 g/mol;

iii) modification of the polyalkyleneimine results in an increase in the atomic C amount, relative to the unmodified polyalkyleneimine, of between 1 and 80%.

45 Claims, No Drawings

FROTH FLOTATION PROCESS FOR THE SEPARATION OF SILICATES AND ALKALINE EARTH METAL CARBONATES USING A COLLECTOR COMPRISING AT LEAST ONE HYDROPHOBICALLY MODIFIED POLYALKYLENEIMINE

CROSS-REFERENCE TO RELATED APPLICATIONS

This application is a U.S. national phase of PCT Application No. PCT/EP2011/053983, filed Mar. 16, 2011, which claims priority to European Application No. 10157099.2, filed Mar. 19, 2010 and U.S. Provisional Application No. 61/341,128, filed Mar. 26, 2010.

The present invention relates to the field of technologies implemented in order to selectively separate alkaline earth metal carbonates and silicates by froth flotation.

A first object of the present invention resides in a process to separate silicates and alkaline earth metal carbonates, characterised in that said process comprises the following steps:

a) providing at least one mineral material comprising at least one silicate and at least one alkaline earth metal carbonate, said mineral material having a weight median grain diameter in the range of from 5 to 1 000 μm;
b) providing at least one hydrophobically modified polyalkyleneimine, wherein:
   i) the polyalkyleneimine is hydrophobically modified by replacement of all or part of the hydrogens of their primary and/or secondary amino groups by functional group R, where R comprises a linear or branched or cyclic alkyl and/or aryl group and contains 1 to 32 carbon atoms;
   ii) prior to modification, the polyalkyleneimine has at least 3 alkyleneimine repeat units and a molecular weight of between 140 and 100 000 g/mol;
   iii) modification of the polyalkyleneimine results in an increase in the atomic C amount, relative to the unmodified polyalkyleneimine, of between 1 and 80%;
c) contacting said mineral material(s) of step a) with said hydrophobically modified polyalkyleneimine(s) of step b), in one or more steps, in an aqueous environment to form an aqueous suspension having a pH of between 7 and 10;
d) passing a gas through the suspension of step c);
e) recovering an alkaline earth metal carbonate-containing product and a silicate-containing product from the suspension.

A second object of the present invention resides in a silicate-containing product obtained by the process of the invention.

A third object of the present invention resides in an alkaline earth metal carbonate-containing product obtained by the process of the invention.

A fourth object of the present invention resides in the use of the silicate-containing product of the invention in cement, concrete or glass applications.

A fifth object of the present invention resides in the use of the alkaline earth metal carbonate-containing product of the invention in paper, paint, plastic, cosmetic and water treatment applications.

Alkaline earth metal carbonates such as dolomite and calcium carbonate, and especially its calcite polymorph, and silicates, such as silica, mica and feldspar, are often found in association with one another in sedimentary rocks such as marble and limestone rock. The separation of these minerals into both a usable alkaline earth metal carbonate fraction and a usable silicate fraction is of high interest to industry, as both products find applications in a wide variety of similar but also different domains.

Calcium carbonate, for example, is widely used as a filler or pigment in base paper sheets and/or in paper coating formulations. It is equally implemented in the plastic, paint, water treatment and cosmetic industries.

Silicates are especially employed in ceramic, concrete and cement applications. Mineral mixtures comprising certain concentrations of silicates find use in agriculture applications. As some of these applications require processing at high temperatures, there are requirements to limit the volatile organic content associated with implemented adducts. The cement industry has the particular requirement to limit the use of additives inducing foaming during processing, such during the production of pathstones.

The most common methods for separating alkaline earth metal carbonate, such as calcium carbonate, and silicates from one another involve physical-chemical separations whereby the sedimentary rock is first ground and then subject to froth flotation in an aqueous environment by employing a means which selectively imparts hydrophobicity to silicate-comprising fractions of the ground material to enable such components to be floated by association with a gas. Another method selectively imparts hydrophobicity to alkaline earth metal carbonate-fractions of the ground material to enable such components to be floated and/or collected by a gas. In the present invention, the alkaline earth metal carbonate-comprising and silicate-comprising fractions are separated by floating the silicate-comprising fraction, which is then collected, and recovering the non-floated alkaline earth metal carbonate-comprising fraction of the mineral material.

Means to provide hydrophobicity to silicates in froth flotation processes are numerous and well known in the art, including from U.S. Pat. No. 3,990,966, which refers to 1-hydroxyethyl-2-heptadecenyl glyoxalidine, 1-hydroxyethyl-2-alkylimidazolines and salt derivations of the imidazoline in this respect. CA 1 187 212 discloses quaternary amines or salts thereof for use as silicate collectors.

WO 2008/084391 describes a process for purification of calcium carbonate-comprising minerals comprising at least one flotation step, characterised in that this step implements at least one quaternary imidazoline methosulfate compound as collector agent.

Another collector in common use is a combination of N-tallow-1,3-diaminopropane diacetate and a tertiary amine having one long carbon chain alkyl group and two polyoxyethylene groups attached to the nitrogen. A significant disadvantage of this approach is that both compounds forming this collector are high melting point solids and to be used they must be dispersed in water using a high energy blender and/or heating, and then actively mixed so as to remain in suspension.

Dicocodimethylammonium chloride is another known silicate collector, but as it requires an alcoholic solvent system to facilitate its manufacturing process, its use incurs flammability risks during manufacturing, storage and use. This product also has relatively high pour and cloud points.

Fatty acid and fatty acid salt-based additives, such as sodium oleate, are often described in froth flotation literature; use of such soaps may cause uncontrolled foaming in later application and they further have very limited selectivity.

In addition to the cited disadvantages associated with currently available options, the skilled man further faces the need to find a process to separate alkaline earth metal carbonates and silicates that minimizes waste, and notably chemical waste.

In response, the Applicant has surprisingly found a particular polymeric organo-nitrogen compound that is as or even more effective than known prior art solutions to separate alkaline earth metal carbonates and silicates by a flotation process. The polymeric organo-nitrogen compound implemented in the invention acts as a single liquid collector, though it may be used in association with other flotation aids. Most notably, the compound implemented in the present invention has the remarkable advantage that it may be recovered for further use through a simple pH adjustment step subsequent to flotation. Moreover, in parallel to recovery of the polymeric organo-nitrogen compound by this pH adjustment step, a silicate fraction is recovered that presents a reduced foaming tendency and hydrophobic behaviour, and is accordingly very useful as a raw material for concrete and cement, among other, applications.

Accordingly, a first object of the present invention resides in a process to separate silicates and alkaline earth metal carbonates, characterised in that said process comprises the following steps:

a) providing at least one mineral material comprising at least one silicate and at least one alkaline earth metal carbonate, said mineral material having a weight median grain diameter in the range of from 5 to 1 000 μm;
b) providing at least one hydrophobically modified polyalkyleneimine, wherein:
   i) the polyalkyleneimine is hydrophobically modified by replacement of all or part of the hydrogens of their primary and/or secondary amino groups by functional group R, where R comprises a linear or branched or cyclic alkyl and/or aryl group;
   ii) prior to modification, the polyalkyleneimine has at least 3 alkyleneimine repeat units and a molecular weight of between 140 and 100 000 g/mol;
   iii) modification of the polyalkyleneimine results in an increase in the atomic of C amount, relative to the unmodified polyalkyleneimine, of between 1 and 80%;
c) contacting said mineral material(s) of step a) with an effective amount of said hydrophobically modified polyalkyleneimine(s) of step b), in one or more steps, in an aqueous environment to form an aqueous suspension having a pH of between 7 and 10;
d) passing a gas through the suspension of step c);
e) recovering an alkaline earth metal carbonate-containing product and a silicate-containing product from the suspension.

A "polyalkyleneimine" in the meaning of the present invention is a polymer having residues of the general formula $—((CH_2)_m—NH)_n—$ where m=2 to 4 and n=3 to 5 000. According to the present invention, the polyalkyleneimine that is hydrophobically modified may be a homopolymeric polyalkyleneimine which can be defined by the ratio of primary, secondary and tertiary amine functions.

For the purpose of the present invention, the weight median grain diameter of a particulate material is measured as described in the Examples section herebelow.

Step a) of the Process of the Invention

Step a) of the process of the invention refers to providing at least one mineral material comprising at least one silicate and at least one alkaline earth metal carbonate, said mineral material having a weight median grain diameter in the range of from 5 to 1 000 μm.

As regards said alkaline earth metal carbonate of step a), this is preferably a calcium and/or magnesium carbonate, and is even more preferably a calcium carbonate, such as marble.

Calcium magnesium carbonates are, for example, dolomite.

In a particular embodiment, said alkaline earth metal carbonate of step a) is a mixture of calcium carbonate and dolomite.

As regards the silicates, these are understood to comprise silicon and oxygen.

Examples of silicates include silica, mica and feldspar. Examples of silica minerals include quartz. Examples of mica minerals include muscovite and biotite. Examples of feldspar minerals include albite and plagioclase. Other silicates include chlorite, clay mineral such as nontronite, and talc. In a preferred embodiment, said silicate is quartz.

In addition to said alkaline earth metal carbonates and said silicates, further trace minerals may be present in said mineral material, such as iron sulphates and/or iron sulphides and/or iron oxides and/or graphite.

In a preferred embodiment, the weight ratio of said alkaline earth metal carbonate(s):silicate(s) in a) is from 0.1:99.9 to 99.9:0.1, and preferably from 80:20 to 99:1.

In another preferred embodiment, the total weight of said alkaline earth metal carbonates and silicates accounts for at least 95%, preferably 98%, by weight relative to the total weight of said mineral material.

In another preferred embodiment, said mineral material has a weight median grain diameter in the range of from 5 to 500 μm, preferably of from 7 to 350 μm in step a).

Said mineral material of step a) may comprise a non-ionic or cationic grinding aid, such as glycol or alkanolamines, respectively. When present, these grinding aids are generally in an amount of from 0.1 to 5 $mg/m^2$, relative to the surface area of said mineral material.

Step b) of the Process of the Invention

Step b) of the process of the invention refers to providing at least one hydrophobically modified polyalkyleneimine, wherein:

i) the polyalkyleneimine is hydrophobically modified by replacement of all or part of the hydrogens of their primary and/or secondary amino groups by functional group R, where R comprises a linear or branched alkyl and/or aryl group;
ii) prior to modification, the polyalkyleneimine has at least 3 alkyleneimine repeat units and a molecular weight of between 140 and 100 000 g/mol;
iii) modification of the polyalkyleneimine results in an increase in the atomic of C amount, relative to the unmodified polyalkyleneimine, of between 1 and 80%.

Without implying any limitation regarding the methods available to the skilled man to undertake the modification of polyalkyleneimine to form a hydrophobically modified polyalkyleneimine, such modifications are generally discussed in Antonetti et al. (Macromolecules 2005, 38, 5914-5920), WO 94/21368, WO 01/21298, WO 2007/110333, WO 02/095122 (as described in the Examples and notably Example 1), US 2003/212200, and U.S. Pat. No. 3,692,092.

Said polyalkyleneimine may be linear or branched before modification. Preferably, said polyalkyleneimine is branched prior to modification.

Prior to modification, said polyalkyleneimine preferably has a molecular weight of from 140 to 50 000 g/mol, and more preferably of from 140 to 25 000 g/mol.

In the case of a linear polyalkyleneimine prior to modification, this linear polyalkyleneimine preferably has a molecular weight of from 140 to 700 g/mol, and more preferably of from 146 to 232 g/mol, prior to modification. Even more preferably, said linear polyalkyleneimine prior to modification is selected from triethylenetetramine, pentaethylenehexamine and tetraethylenepentamine.

In the case of a branched polyalkyleneimine prior to modification, this branched polyalkyleneimine preferably has a molecular weight of from 500 to 50 000 g/mol, and more preferably of from 800 to 25 000 g/mol, prior to modification.

For the purpose of the present invention, the "molecular weight" of linear polyalkyleneimines prior to modification may be directly calculated from the respective chemical formula. The "molecular weight" of branched polyalkyleneimines prior to modification in the meaning of the present invention is the weight average molecular weight as measured by light scattering (LS) techniques.

The ratio of primary, secondary and tertiary amine functions in the branched polyethylenimines prior to modification is preferably in the range of 1:0.86:0.42 to 1:1.7:1.7, measured by inverse gated $^{13}C$ NMR spectroscopy as described in Antonetti et al. (Macromolecules 2005, 38, 5914-5920).

In a most preferred embodiment, said polyalkyleneimine is a polyethylenimine.

Hydrophobic modification proceeds by reacting said polyalkyleneimine with one or more chemical groups in order to replace all or part of the hydrogens of the primary or secondary amino groups by functional group R, where R comprises a linear or branched alkyl and/or aryl groups.

R may in addition to said alkyl or aryl group, further comprise oxygen, carboxyl, hydroxyl and/or nitrogen groups. Said alkyl group may be linear, branched or cyclic, and may be saturated or unsaturated.

In a preferred embodiment, R is selected from the group consisting of linear or branched fatty amides or amines, cyclic amides or amines, and mixture thereof, and more preferably is a linear or branched fatty amide, a cyclic amide or a mixture thereof.

In a more preferred embodiment, R is a C1 to C32 fatty amide(s), even more preferably a C5 to C18 fatty amide(s), and most preferably a C5 to C14 linear fatty amide(s).

In another embodiment, between 1 and 30 number % of the R groups are an alkoxylate, in which case this alkoxylate is preferably an ethoxylate, more preferably with 10 to 50 ethylene oxide groups.

Preferably, said hydrophobically modified polyalkyleneimine is provided in the form of an organic solvent-free product. For the purpose of the present invention, an organic solvent is an organic liquid having a boiling point of below 250° C.

Preferably, said hydrophobically modified polyalkyleneimine has a boiling point of greater than 250° C.

Step c) of the Process of the Invention

Step c) of the process of the invention refers to contacting said mineral material(s) of step a) with an effective amount of said hydrophobically modified polyalkyleneimine(s) of step b), in one or more steps, in an aqueous environment to form an aqueous suspension having a pH of between 7 and 10.

In one embodiment, said mineral material is in a dry state and is contacted with said hydrophobically modified polyalkyleneimine prior forming said aqueous suspension. In this embodiment, said mineral material in a dry state may optionally be ground with said hydrophobically modified polyalkyleneimine.

In an alternative embodiment, said mineral material is first introduced in an aqueous environment, and said hydrophobically modified polyalkyleneimine is added thereafter to this aqueous environment to form said aqueous suspension.

In another alternative embodiment, said hydrophobically modified polyalkyleneimine is first introduced in an aqueous environment, and said mineral material is added thereafter to this aqueous environment to form said aqueous suspension.

In a preferred embodiment, said hydrophobically modified polyalkyleneimine is added in an amount of from 50 to 5 000 ppm, and preferably from 100 to 1 500 ppm, based on the total dry weight of said mineral material of step a).

In an alternative preferred embodiment, said hydrophobically modified polyalkyleneimine is added in an amount of from 5 to 50 mg of said hydrophobically modified polyalkyleneimine/$m^2$, preferably of from 10 to 45 mg said hydrophobically modified polyalkyleneimine/$m^2$ of silicate in said mineral material of step a). The surface area of said silicate is determined according to the measurement method provided in the Examples section hereafter.

Preferably, the aqueous suspension formed in step c) is formed under agitation. In an optional embodiment, the aqueous suspension formed in step c) is ground before proceeding to step d).

Preferably, the aqueous suspension formed in step c) has a solids content, measured as described in the Examples section hereafter, of between 5 and 60%, and preferably of between 20 and 55%, by dry weight relative to the total aqueous suspension weight.

Step d) of the Process of the Invention

Step d) of the process of the invention refers to passing a gas through the suspension formed in step c).

Said gas is generally introduced in the vessel of step d) via one or more entry ports located in the lower half the vessel. Alternatively or additionally, said gas may be introduced via entry ports located on an agitation device in said vessel. Said gas then naturally rises upwards through the suspension.

More particularly, step d) may implement an agitation cell and/or a flotation column and/or a pneumatic flotation device and/or a flotation device featuring a gas injection.

Said gas is preferably air.

It is preferred that the gas feature a bubble size in the suspension of between 0.01 and 10 mm.

During step d), the gas flow rate is preferably between 1 and 10 $dm^3$/min, more preferably between 3 and 7 $dm^3$/min in a 4 $dm^3$ flotation cell.

During step d), the suspension preferably has a temperature of between 5 and 90° C., and more preferably of between 25 and 50° C.

Step d) is preferably performed under agitation.

Step d) may be continuous or discontinuous.

Preferably, step d) is performed until no more solid material can be collected from the foam.

Step e) of the Process of the Invention

Step e) of the process of the invention refers to recovering an alkaline earth metal carbonate fraction and a silicate fraction from the suspension.

Hydrophobised silicate-comprising particles are upheld within the suspension and concentrated in a supernatant foam at the surface. This foam can be collected by skimming it off the surface, using for example a scraper, or simply by allowing it to overflow, passing into a separate collection container.

The non-floated, alkaline earth metal carbonate-comprising fraction remaining in the suspension can be collected by filtration to remove the aqueous phase, by decantation or by other means commonly employed in the art to separate liquids from solids.

The collected silicate-comprising fraction may be subjected to one or more further steps of froth flotation, according to the invention or according to prior art froth flotation methods.

Likewise, the collected alkaline earth metal carbonate-comprising fraction may be subjected to one or more further steps of froth flotation, according to the invention or according to prior art froth flotation methods.

Further Optional Process Steps

In one embodiment, step e) of the process of the present invention is followed by a step f) of raising the pH of the silicate fraction of step e) in an aqueous environment by at least 0.5 pH units, and preferably by at least 1 pH unit. In a most preferred embodiment, the pH of the silicate fraction in an aqueous environment is raised to above a pH of 10. This may be performed by washing said silicate fraction with an aqueous alkaline solution to recover a solid silicate fraction and a liquid fraction. In a preferred embodiment, said silicate fraction is washed with an aqueous solution of calcium hydroxide.

Increasing the pH of the silicate fraction has the effect that all or part of the hydrophobically modified polyalkyleneimine is desorbed from the silicate fraction and extracted into the washing liquid.

Step f) is preferably performed at a temperature of between 5 and 95° C., and more preferably of between 20 and 80° C.

In the embodiment where step f) is implemented, step f) may be followed by step g) of treating said liquid fraction of step f) with an acid, such as phosphoric acid, in order to reduce the pH of this liquid fraction by at least 0.5 pH units, and preferably of at least 1 pH unit.

This has the effect of recovering a hydrophobically modified polyalkyleneimine suitable for use as the hydrophobically modified polyalkyleneimine of step b) of the process of the present invention.

In parallel, this has the effect that when said silicate-containing product is separated from the liquid phase after pH modification and dried, it preferably comprising less than 66%, more preferably less than 50%, and even more preferably less than 30%, by weight of said hydrophobically modified polyalkyleneimine relative to the amount of hydrophobically modified polyalkyleneimine prior to pH modification.

In the embodiment where step f) is implemented, step f) may additionally or alternatively be followed by step h), which takes place before, during or after any step g), of concentrating said liquid fraction of step f) mechanically and/or thermally. Additionally or alternatively, the liquid fraction of step f) containing the desorbed hydrophobically modified polyalkyleneimine may be concentrated by an elektrophoresis process well known in the prior art.

In the embodiment where the hydrophobically modified polyalkyleneimine recovered in step g) is implemented as the hydrophobically modified polyalkyleneimine of step b), said recovered hydrophobically modified polyalkyleneimine may be implemented in a process according to the invention, accounting for at least 30%, preferably at least 50%, and more preferably at least 66% by weight of said hydrophobically modified polyalkyleneimine of step b).

Alkaline Earth Metal Carbonate-Containing Product Obtained by the Process of the Invention Another object of the present invention lies in an alkaline earth metal carbonate-containing product obtained by the process of the invention.

In a preferred embodiment, said alkaline earth metal carbonate-containing product obtained by the process of the invention consists of greater than or equal to 95%, preferably of greater than or equal to 98%, most preferably greater than 99.9%, by weight of alkaline earth metal carbonate relative to the total weight of said alkaline earth metal carbonate-containing product.

Said alkaline earth metal carbonate-containing product may be used in paper, paint, plastic, cosmetic and water treatment applications.

Silicate-Containing Product Obtained by the Process of the Invention

Another object of the present invention lies in a silicate-containing product obtained by the process of the invention.

In a preferred embodiment, said silicate-containing product obtained by the process of the invention has a weight ratio of said alkaline earth metal carbonate(s): silicate(s) of from 10:90 to 20:80, and preferably of from 40:60 to 30:70.

Said silicate-containing product may be used in agriculture, glass, ceramic, concrete and cement applications.

The following are non-limitative examples illustrating the invention in comparison to the prior art.

EXAMPLES

In the following examples, the minerals identified have the following corresponding chemical formula.

| Mineral name | Chemical Formula |
|---|---|
| Silicates (non-exhaustive list) | |
| Quartz | $SiO_2$ |
| Muskovite | $KAl_2(Si_3Al)O_{10}(OH,F)_2$ |
| Biotite | $K(Mg,Fe)_3(AlSi_3)O_{10}(OH,F)_2$ |
| Chlorite | $Na_{0.5}Al_4Mg_2Si_7AlO_{18}(OH)_{12}\bullet5(H_2O)$ |
| Plagioclase | $(Na,Ca)(Si,Al)_4O_8$ |
| Potassium Feldspar | $KAlSi_3O_8$ |
| Nontronite | $Na_{0.3}Fe_2Si_3AlO_{10}(OH)_2\bullet4(H_2O)$ |
| Talc | $Mg_3Si_4O_{10}(OH)_2$ |
| Albite | $NaAlSi_3O_8$ |
| Non-silicates (non-exhaustive list) | |
| Graphite | C |
| Pyrite | $FeS_2$ |
| Magnetite | $Fe_3O_4$ |

Measurement Methods

Weight Solids (% by Weight) of a Material in Suspension

The weight solids is determined by dividing the weight of the solid material by the total weight of the aqueous suspension.

The weight of the solid material is determined by weighing the solid material obtained by evaporating the aqueous phase of suspension and drying the obtained material to a constant weight Particle Size Distribution (Mass % Particles with a Diameter <X) and Weight Median Grain Diameter ($d_{50}$) of Particulate Material Weight median grain diameter and grain diameter mass distribution of a particulate material are determined using a Malvern Mastersizer 2000 (based on the Fraunhofer equation).

Carbonate Fraction Determination (% by Weight)

10 g of mineral material is dissolved in 150 g of an aqueous solution of 10% active content hydrochloric acid under heating at between 95 and 100° C. Following complete dissolution, the solution is allowed to cool to room temperature, and thereafter is filtered and washed on a 0.2 μm membrane filter. The collected material, including the filter, is then dried in an oven at 105° C. to constant weight. The so-dried material ("insoluble material") is then allowed to cool to room temperature and weighed, correcting the weight by subtracting the filter weight (hereafter the "insoluble weight"). This insoluble weight value is subtracted from 10 g, and the resulting figure is then multiplied by 100% and divided by 10 g, to give the carbonate fraction.

Silicate Fraction Determination (% by Weight)

0.5 g of the insoluble material obtained as described in the carbonate fraction determination method is analysed by X-ray diffraction (XRD). Samples were analyzed with a Bruker D8 Advance powder diffractometer obeying Bragg's law. This diffractometer consists of a 2.2 kW X-ray tube, a sample holder, a θ-θ goniometer, and a VÅNTEC-1 detector. Nickel-filtered Cu Kα radiation was employed in all experiments. The profiles were chart recorded automatically using a scan speed of 0.7° per minute and a step size of 0.007° in 2θ. The resulting powder diffraction patterns were classified by mineral content using the DIFFRAC$^{plus}$ software packages EVA and SEARCH, based on reference patterns of the ICDD PDF 2 database. Quantitative analysis of diffraction data refers to the determination of amounts of different phases in a multi-phase sample and is performed using the DIFFRAC$^{plus}$ software package TOPAS.

Silicate Specific Surface Area Determination ($m^2/g$)

The specific surface area of the insoluble material obtained as described in the carbonate fraction determination method was measured using a Malvern Mastersizer 2000 (based on the Fraunhofer equation).

Chemical Oxygen Demand (COD)

The Chemical Oxygen Demand is measured according to the Lange Method, as described in the document issued by HACH LANGE LTD, entitled "DOC042.52.20023.Nov08". Approximately 100 mg of the dry insoluble material obtained as described in the carbonate fraction determination method is first made into an aqueous suspension having a solids content of 10% by dry weight. This suspension was then analyzed according to the Lange Method.

% N and % C in a Polyalkyleneimine

The % of N and C in the polyalkyleneimine was determined by elemental analysis using a VarioEL III CHNS-Analyzer (commercialized by Elementar Analysensysteme GmbH in Hanau, Germany).

Materials

Reagent A

Reagent A is a 1-alkyl-3-amino-3-aminopropane monoacetate, where the alkyl group has 16 to 18 carbon atoms.

Further Reagents

Further reagents used in the examples below are described in the following table.

TABLE 1

| Reagent | Composition | N [%] | C [%] | % C/ % N | C in R [%] (**) |
|---|---|---|---|---|---|
| PEI* | Unmodified PEI with Mw = 800 g/mol ("PEI 800") | 32.6 | 62.9 | 1.9 | — |
| 1 | PEI 800 backbone, modified with saturated C12 fatty acid | 28.6 | 58.8 | 2.1 | 3.6 |
| 2 | PEI 800 backbone, modified with saturated C12 fatty acid | 12.6 | 69.4 | 5.5 | 45.1 |
| 3 | PEI backbone with Mw = 1 300 g/mol, modified with saturated C12 fatty acid | 13.4 | 71.9 | 5.3 | 45.9 |
| 4 | PEI backbone with Mw = 5 000 g/mol, modified with saturated C12 fatty acid | 12.7 | 69.7 | 5.5 | 45.2 |
| 5 | PEI backbone with Mw = 5 000 g/mol, modified with a mixture of saturated C16 fatty acid and unsaturated C18 fatty acid | 10.0 | 73.5 | 7.3 | 54.2 |
| 6 | PEI backbone with Mw = 5 000 g/mol, modified with saturated C18 fatty acid | 9.5 | 73.5 | 7.7 | 55.1 |
| 7 | PEI backbone with Mw = 5 000 g/mol, modified with saturated C5 fatty acid | 19.5 | 62.9 | 3.2 | 25.3 |
| 8 | PEI backbone with Mw = 25 000 g/mol, modified with saturated C5 fatty acid | 18.0 | 61.0 | 3.4 | 26.3 |

*PEI = polyethylenimine (**) based on N/C ratio of PEI with a molecular weight (Mw) of 800 g/mol The % increase of carbon atoms in the modified polyethyleneimine relative to the unmodified polyethyleneimine, said carbon atoms accounting for the increase being in the R groups introduced during modification (i.e. "C in R"), is determined as follows.

% C in the backbone of the modified polyethyleneimine=(% N in modified polyethyleneimine)×(% C/% N of unmodified polyethyleneimine)

% C in the R groups of the modified polyethyleneimine("% C in R")=(% C in the modified polyethyleneimine)−(% C in the backbone of the modified polyethyleneimine)

Example 1

The froth flotations of Example 1 were performed at room temperature in an Outokumpu 4-$dm^3$ capacity laboratory flotation machine (DWG 762720-1, 2002), equipped with a gassing agitator, under an agitation of 1 200 rpm.

The solids content of the aqueous mineral material suspension added to the flotation machine was of 26% by dry weight, said mineral material being sourced from sedimentary marble rock (origin: Kernten, Austria), pre-ground to the particle size distribution characteristics listed in Table 2. The mineralogical composition of this material is given in Table 3. This aqueous suspension was prepared using tap water having a hardness of 18° German hardness (dH).

TABLE 2

| Diameter X | Mass % particles with a diameter < X |
|---|---|
| <250 μm | 99% |
| <200 μm | 97% |
| <160 μm | 94% |
| <125 μm | 91% |
| <100 μm | 86% |

TABLE 2-continued

| Diameter X | Mass % particles with a diameter < X |
|---|---|
| <71 μm | 76% |
| <45 μm | 61% |
| <25 μm | 43% |
| <10 μm | 23% |
| <5 μm | 14% |
| <2 μm | 7% |
| <1 μm | 3% |
| <0.7 μm | 1% |
| Median Diameter ($d_{50\%}$) | 31.75 μm |
| Top Cut ($d_{98\%}$) | 221 μm |

TABLE 3

| Mineral name | % weight on total weight |
|---|---|
| Calcium carbonate | 97.6 |
| Silicates | approximately 2.2 (Specific surface area 0.4 $m^2$/g silicates) |
| Impurities (essentially magnetite and graphite) | approximately 0.2 |

A given amount of the indicated flotation agent in Table 4 was introduced and mixed with the suspension.

A flotation gas, consisting of air, was then introduced via orifices situated along the axis of the agitator at a rate of approximately 5 $dm^3$/min.

The foam created at the surface of the suspension was separated from the suspension by overflow and skimming until no more foam could be collected, and both the remaining suspension and the collected foam were dried in order to form two concentrates.

The concentrates were then characterised and the results reported in the Table 4.

TABLE 4

| Test | Prior Art (PA)/ Invention (IN) | Reagent | Additive dose [ppm, dry additive on dry feed] | Additive dose in mg/$m^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 1 | PA | A | 300 | 32 | 10 | 98.0 | 4 |
| 2 | IN | 7 | 300 | 32 | 35 | >99.9 | 16 |
| 3 | IN | 7 | 350 | 37 | 33 | >99.5 | 15 |
| 4 | IN | 5 | 450 | 48 | 27 | >99.0 | 12 |
| 5 | IN | 5 | 300 | 32 | 32 | >99.0 | 15 |
| 6 | IN | 4 | 300 | 32 | 39 | >99.0 | 18 |
| 7 | IN | 3 | 300 | 32 | 37 | >99.0 | 17 |
| 8 | IN | 8 | 300 | 32 | 19 | >99.0 | 9 |

The silicate-comprising product (silicate fraction) of Trial 2 was further analysed.

TABLE 5

| Mineral name | % wt. in the feed | % wt. in the silicate phase | Concentration of given mineral in the silicate fraction relative to given mineral concentration in the feed |
|---|---|---|---|
| Quartz | 0.5 | 3.5 | 7 |
| Graphite | 0.2 | 5.7 | 29 |

Example 2

The same protocol as in Example 1 was used based on the conditions of Test 2 (additive 7), except that the solids content of the suspension was adjusted relative to Test 2 as indicated in the table below.

TABLE 6

| Test | Prior Art (PA)/ Invention (IN) | Solids content suspension [wt %] | Additive dose [ppm, dry additive on dry feed] | Additive dose in mg/m$^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 9 | IN | 7.5 | 300 | 32 | 33 | >99.0 | 15 |
| 10 | IN | 40 | 300 | 32 | 24 | >99.0 | 11 |

Example 3

The same protocol as in Example 1 was used based on the conditions of Test 2 (additive 7), except that the aqueous suspension was prepared using water having a hardness of <1° German hardness (dH).

TABLE 7

| Test | Prior Art (PA)/ Invention (IN) | Solids content suspension [wt %] | Additive dose [ppm, dry additive on dry feed] | Additive dose in mg/m$^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 11 | IN | 26 | 300 | 32 | 15 | >99.0 | 7 |

Example 4

The same protocol as in Example 1 was used based on the conditions of Test 2 (additive 7), except that flotation took place under heating at 50° C.

TABLE 8

| Test | Prior Art (PA)/ Invention (IN) | Solids content suspension [wt %] | Additive dose [ppm, dry additive on dry feed] | Additive dose in mg/m$^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 12 | IN | 26 | 300 | 32 | 20 | >99.0 | 9 |

Example 5

The same protocol as in Example 1 was used, except that the feed originated from a Norwegian quarry and presented the following characteristics.

TABLE 9

| Diameter X | Mass % particles with a diameter < X |
|---|---|
| <400 μm | 99% |
| <315 μm | 98% |
| <250 μm | 97% |
| <200 μm | 95% |
| <160 μm | 92% |
| <125 μm | 88% |
| <100 μm | 83% |
| <71 μm | 75% |
| <45 μm | 61% |
| <25 μm | 44% |
| <10 μm | 27% |
| <5 μm | 19% |
| <2 μm | 10% |

TABLE 9-continued

| Diameter X | Mass % particles with a diameter < X |
|---|---|
| <1 μm | 4% |
| <0.7 μm | 2% |
| <0.5 μm | 1% |
| Median Diameter ($d_{50\%}$) | 31.58 μm |
| Top Cut ($d_{98\%}$) | 301 μm |

TABLE 10

| Mineral name | % weight on total weight |
|---|---|
| Calcium carbonate | 97 |
| Silicates | approximately 2.9 (Specific surface area 0.2 $m^2$/g silicates) |
| Impurities (essentially magnetite and pyrite) | approximately 0.1 |

Comparing Tests 15 and 16, and comparing Tests 17 and 18, we see that approximately half of the flotation additive could be obtained in the recovery.

Example 7

The silicate fraction from Test 9 above was placed in a Büchner funnel and washed with 1 $dm^3$ of an aqueous NaOH solution having a pH of 10. A part of the washed fraction was then dried overnight at 105° C. before measuring the chemical oxygen demand (COD). The results are reported under Test 19.

The remaining part of the washed fraction above not subjected to drying was then washed again, this time with an aqueous NaOH solution having a pH of 11. Again, a part of the washed fraction was then dried overnight at 105° C. before measuring the COD. The results are reported under Test 20.

TABLE 11

| Test | Prior Art (PA)/ Invention (IN) | Reagent | Additive dose [ppm, dry additive on dry feed] | Additive dose in mg/$m^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 13 | PA | A | 300 | 52 | 9 | 98 | 3 |
| 14 | IN | 7 | 300 | 52 | 22 | >99.0 | 7 |

Example 6

The same protocol as in Example 1 was used based on the conditions of Test 2 (additive 7), except that the amount of Reagent 7 was varied.

After complete flotation (Test 15), the foam is collected, filtered and the filter cake is washed with an aqueous NaOH solution of pH 10. The filtrate is adjusted with phosphoric acid to pH 9. This solution is reused for a subsequent flotation experiment (Test 16). As can be seen in Test 16, only 125 ppm of new flotation agent is necessary in addition to this recovered flotation agent for complete flotation.

Tests 17 and 18 are run similarly to Tests 15 and 16, the difference being that the pH of the solution of desorbed flotation agents (in Test 18) is adjusted to pH 7.8 prior to further use in flotation.

TABLE 12

| Test | Prior Art (PA)/ Invention (IN) | Solids content suspension [wt %] | Additive dose [ppm, dry additive on dry feed] | Additive dose in mg/$m^2$ silicate | Silicate in the silicate fraction [wt %] | Carbonate in the carbonate fraction [wt %] | Concentration of silicate in the silicate fraction relative to silicate in the feed |
|---|---|---|---|---|---|---|---|
| 15 | IN | 26 | 250 | 26 | 35 | >99.0 | 16 |
| 16 | IN | 26 | 125 | 13 | 36 | >99.0 | 17 |
| 17 | IN | 26 | 250 | 26 | 33 | >99.0 | 15 |
| 18 | IN | 26 | 125 | 13 | 35 | >99.0 | 16 |

TABLE 13

| Test | COD [mg $O_2$/$dm^3$ suspension] | Reduction of COD relative to Test 9 [%] |
|---|---|---|
| 9 | 2000 | — |
| 19 | 986 | 50.7 |
| 20 | 341 | 83 |

The results of the above Table show that a significant portion of the flotation agent could be removed from the silicate fraction by simple pH adjustment effected by one or more washing steps.

The invention claimed is:

1. A process for separating silicates and alkaline earth metal carbonates, wherein the process comprises the following steps:

a) providing at least one mineral material comprising at least one silicate and at least one alkaline earth metal carbonate, said mineral material having a weight median grain diameter in the range of from 5 to 1000 μm;

b) providing at least one hydrophobically modified polyalkyleneimine, wherein:

i) the polyalkyleneimine is hydrophobically modified by replacement of all or part of the hydrogens of their primary and/or secondary amino groups by functional group R, where R comprises a linear or branched or cyclic alkyl and/or aryl group and contains 1 to 32 carbon atoms;

ii) prior to modification, the polyalkyleneimine has at least 3 alkyleneimine repeat units and a molecular weight of between 140 and 100,000 g/mol;

iii) modification of the polyalkyleneimine results in an increase in the atomic C amount, relative to the unmodified polyalkyleneimine, of between 1 and 80%;

c) contacting said mineral material(s) of step a) with said hydrophobically modified polyalkyleneimine(s) of step b), in one or more steps, in an aqueous environment to form an aqueous suspension having a pH of between 7 and 10;

d) passing a gas through the suspension of step c);

e) recovering an alkaline earth metal carbonate-containing product and a silicate-containing product from the suspension;

f) raising the pH of the silicate of step e) in an aqueous environment by at least 0.5 pH units to desorb all or part of the hydrophobically modified polyalkyleneimine(s) from the silicate fraction and extracting the hydrophobically modified polyalkyeleneimine(s) into the washing liquid; and g) treating the liquid fraction of step f) with an acid to reduce the pH of this liquid fraction by at least 0.5 pH units.

2. The process according to claim 1, wherein the alkaline earth metal carbonate of step a) is a calcium and/or magnesium carbonate.

3. The process according to claim 1, wherein the alkaline earth metal carbonate of step a) is a calcium carbonate.

4. The process according to claim 1, wherein the alkaline earth metal carbonate of step a) is marble or dolomite containing calcium carbonate.

5. The process according to claim 1, wherein the silicate of step a) is a silica, mica or feldspar.

6. The process according to claim 1, wherein the silicate of step a) is a quartz.

7. The process according to claim 1, wherein the weight ratio of the alkaline earth metal carbonate(s) : silicate(s) in the mineral material of step a) is from 0.1:99.9 to 99.9:0.1.

8. The process according to claim 1, wherein the weight ratio of the alkaline earth metal carbonate(s) : silicate(s) in the mineral material of step a) is from 80:20 to 99:1.

9. The process according to claim 1, wherein the total of the alkaline earth metal carbonates and the silicates accounts for at least 95%, by weight relative to the total weight of the mineral material.

10. The process according to claim 1, wherein the total of the alkaline earth metal carbonates and the silicates accounts for at least 98%, by weight relative to the total weight of the mineral material.

11. The process according to claim 1, wherein the mineral material has a weight median grain diameter in the range of from 5 to 500 μm in step a).

12. The process according to claim 1, wherein the mineral material has a weight median grain diameter in the range of from 7 to 350 μm in step a).

13. The process according to claim 1, wherein the mineral material comprises a non-ionic or cationic grinding aid.

14. The process according to claim 1, wherein the polyalkyleneimine is linear or branched prior to modification.

15. The process according to claim 1, wherein the polyalkyleneimine is branched prior to modification.

16. The process according to claim 1, wherein prior to modification, the polyalkyleneimine has a molecular weight of from 140 to 50,000 g/mol.

17. The process according to claim 1, wherein prior to modification, the polyalkyleneimine has a molecular weight of from 140 to 25,000 g/mol.

18. The process according to claim 1, wherein the ratio of primary, secondary and tertiary amine functions in the branched polyethylenimines prior to modification is in the range of 1:0.86:0.42 to 1:1.7:1.7.

19. The process according to claim 1, wherein the polyalkyleneimine is a polyethylenimine.

20. The process according to claim 1, wherein the R functional group(s) of the hydrophobically modified polyalkyleneimine comprise oxygen, carboxyl, hydroxyl and/or nitrogen groups.

21. The process according to claim 1, wherein the R functional group(s) of the hydrophobically modified polyalkyleneimine are selected from the group consisting of linear or branched fatty amides or amines, cyclic amides or amines, and mixture thereof.

22. The process according to claim 1, wherein the R functional group(s) of the hydrophobically modified polyalkyleneimine is a linear or branched fatty amide, a cyclic amide or a mixture thereof.

23. The process according to claim 1, wherein the R functional group(s) of the hydrophobically modified polyalkyleneimine are a C1 to C32 fatty amide(s).

24. The process according to claim 1, wherein the R functional group(s) of the hydrophobically modified polyalkyleneimine are a C5 to C18 fatty amide(s).

25. The process according to claim 1, wherein the R functional group(s) of the hydrophobically modified polyalkyleneimine are a C5 to C14 linear fatty amide(s).

26. The process according to claim 1, wherein between 1 and 30 number % of the R groups are an alkoxylate.

27. The process according to claim 1, wherein between 1 and 30 number % of the R groups are an ethoxylate.

28. The process according to claim 1, wherein between 1 and 30 number % of the R groups are an ethoxylate with 10 to 50 ethylene oxide groups.

29. The process according to claim 1, wherein the hydrophobically modified polyalkyleneimine is added in an amount of from 50 to 5000 ppm, based on the total dry weight of the mineral material of step a).

30. The process according to claim 1, wherein the hydrophobically modified polyalkyleneimine is added in an amount of from 100 to 1500 ppm, based on the total dry weight of the mineral material of step a).

31. The process according to claim 1, wherein the hydrophobically modified polyalkyleneimine is added in an amount of from 5 to 50 mg of the hydrophobically modified polyalkyleneimine/$m^2$ of silicate in said mineral material of step a).

32. The process according to claim 1, wherein the hydrophobically modified polyalkyleneimine is added in an amount of from 10 to 45 mg of the hydrophobically modified polyalkyleneimine/$m^2$ of silicate in said mineral material of step a).

33. The process according to claim 1, wherein the aqueous suspension formed in step c) has a solids content of between 5 and 60% by dry weight relative to the total aqueous suspension weight.

34. The process according to claim 1, wherein the aqueous suspension formed in step c) has a solids content of between 20 and 55% by dry weight relative to the total aqueous suspension weight.

35. The process according to claim 1, wherein the gas of step d) is air.

36. The process according to claim 1, wherein during step d), the suspension has a temperature of between 5 and 90° C.

37. The process according to claim 1, wherein during step d), the suspension has a temperature of between 25 and 50° C.

38. The process according to claim 1, wherein in step f) the pH of the silicate fraction of step e) in an aqueous environment is raised by at least 1 pH unit.

39. The process according to claim 1, wherein the pH of the silicate fraction in an aqueous environment is raised to above a pH of 10.

40. The process according to claim 1, wherein in step g) the liquid fraction of step f) is treated with an acid to reduce the pH of this liquid fraction by at least 1 pH unit.

41. The process according to claim 1, wherein step f) is followed by step h), which takes place before, during or after any step g), of concentrating the liquid fraction of step f) mechanically and/or thermally.

42. The process according to claim 1, wherein following pH modification, the silicate-containing product is separated from the liquid phase and dried, thereafter comprising less than 30% by weight of said hydrophobically modified polyalkyleneimine relative to the amount of hydrophobically modified polyalkyleneimine prior to pH modification.

43. The process according to claim 1, wherein following pH modification, the silicate-containing product is separated from the liquid phase and dried, thereafter comprising less than 50% by weight of said hydrophobically modified polyalkyleneimine relative to the amount of hydrophobically modified polyalkyleneimine prior to pH modification.

44. The process according to claim 1, wherein following pH modification, the silicate-containing product is separated from the liquid phase and dried, thereafter comprising less than 66% by weight of said hydrophobically modified polyalkyleneimine relative to the amount of hydrophobically modified polyalkyleneimine prior to pH modification.

45. The process according to claim 40, wherein a hydrophobically modified polyalkyleneimine recovered in step g) is implemented as the hydrophobically modified polyalkyleneimine of step b).

* * * * *